US007994694B2

(12) United States Patent
Moribe et al.

(10) Patent No.: US 7,994,694 B2
(45) Date of Patent: Aug. 9, 2011

(54) SPARK PLUG FOR INTERNAL COMBUSTION ENGINE

(75) Inventors: Mai Moribe, Inazawa (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 311 days.

(21) Appl. No.: 12/057,466

(22) Filed: Mar. 28, 2008

(65) Prior Publication Data

US 2008/0238284 A1 Oct. 2, 2008

(30) Foreign Application Priority Data

Mar. 30, 2007 (JP) ..... 2007-091985
Jan. 16, 2008 (JP) ..... 2008-006391

(51) Int. Cl.
*H01T 13/00* (2006.01)

(52) U.S. Cl. ..... 313/144

(58) Field of Classification Search ..... 313/118, 313/143–145

See application file for complete search history.

(56) References Cited

U.S. PATENT DOCUMENTS

| | | | | |
|---|---|---|---|---|
| 1,570,320 | A | 1/1926 | Serewicz | |
| 4,015,161 | A | 3/1977 | Resler, Jr. | |
| 5,186,132 | A | 2/1993 | Runge | |
| 6,414,420 | B1 | 7/2002 | Suzuki | |
| 2002/0036451 | A1 * | 3/2002 | Nishikawa et al. | 313/118 |
| 2003/0117052 | A1 | 6/2003 | Yamaguchi et al. | |
| 2003/0168954 | A1 | 9/2003 | Suzuki | |
| 2003/0168955 | A1 | 9/2003 | Suzuki | |
| 2005/0017622 | A1 | 1/2005 | Tamura | |

FOREIGN PATENT DOCUMENTS

| | | | |
|---|---|---|---|
| JP | 16-3036 | U | 3/1941 |
| JP | 49-77325 | U | 7/1974 |
| JP | 2000-215964 | A | 8/2000 |
| JP | 2003-142224 | A | 5/2003 |
| JP | 2003-257582 | A | 9/2003 |
| JP | 2003-257583 | A | 9/2003 |
| JP | 2005-44627 | A | 2/2005 |
| WO | 95/25371 | A1 | 9/1995 |

OTHER PUBLICATIONS

Extended European Search Report dated Jul. 8, 2008.

* cited by examiner

*Primary Examiner* — Joseph L Williams
*Assistant Examiner* — Brenitra M Lee
(74) *Attorney, Agent, or Firm* — Sughrue Mion, PLLC

(57) ABSTRACT

A spark plug (1) for an internal combustion engine includes: a cylindrical insulator (2) having an axial hole (4) penetrating in a direction of an axis (C1); a center electrode (5) partially inserted in the axial hole (4); a metal shell (3) surrounding an outer periphery of the insulator (2) and which is fixed to the insulator (2) by means of a crimped portion (20) provided at a rear end portion of the metal shell (3); and a ground electrode (27) joined to the metal shell (3) such that a portion of the ground electrode (27) opposes a leading end portion of the center electrode (5) via a spark discharge gap (33), wherein the insulator (2) has an annular groove portion (23) which opposes an inner edge of the crimped portion (20).

8 Claims, 7 Drawing Sheets

SPARK PLUG FOR INTERNAL COMBUSTION ENGINE

BACKGROUND OF THE INVENTION

1. Field of the Invention

The present invention relates to a spark plug for an internal combustion engine.

2. Description of the Related Art

A spark plug for an internal combustion engine is installed in an internal combustion engine of an automobile or the like and is used for igniting an air-fuel mixture. The spark plug generally comprises a center electrode, an insulator provided on the outer side of the center electrode, and a cylindrical metal shell provided on the outer side of the insulator. In addition, the insulator has a rear end-side trunk portion formed on its rear end side, a large-diameter portion formed on a leading end side of the rear end-side trunk portion, and an intermediate trunk portion and a long leg portion formed on a leading end side of the large-diameter portion. The insulator and the metal shell are combined, for example, in a state in which the insulator is inserted in the metal shell, a rear end portion of the metal shell is crimped, and the crimped portion is retained at a rear end of the large-diameter portion (e.g., refer to JP-A-2003-257583 (corresponding to US 2003/0168955A1)).

The spark plug is exposed to a high temperature in a combustion chamber, and a high combustion pressure is instantaneously applied thereto during combustion of the air-fuel mixture. Accordingly, the metal shell and the insulator making up the spark plug must have sufficient gas-tightness so as to be capable of preventing the air-gas mixture from leaking outside the combustion chamber under high temperature and pressure conditions, as well as stability in a tightened state so as to be capable of withstanding the combustion pressure. If an engagement allowance of the crimped portion with respect to a rear end of the large-diameter portion is insufficient, a gap is likely to occur between the insulator and the metal shell. Consequently, the force with which the insulator is held by the crimped portion declines, possibly leading to a decline in gas-tightness. In addition, as the engagement allowance decreases, the holding force of the crimped portion declines, with the result that stability of the tightened state of the insulator with respect to the metal shell can possibly decline. Accordingly, it is important to secure a sufficient engagement allowance of the crimped portion.

Incidentally, in recent years, there has been a demand for compact-sized and small-diameter spark plugs. To realize a small-diameter spark plug, the metal shell may be made thin-walled or the diameter of the overall insulator may be reduced. However, adoption of either method leads to a decline in the strength of the spark plug, and there is a possibility that the spark plug cannot withstand the aforementioned harsh environment of the interior of the combustion chamber. Accordingly, a small-diameter spark plug may be realized while ensuring necessary strength by reducing the diameter of mainly the most thick-walled large-diameter portion of the insulator.

3. Problems to be Solved by the Invention

However, if the large-diameter portion is thus reduced in diameter, the difference in diameter between the large-diameter portion and the rear end-side trunk portion disadvantageously becomes relatively small. Consequently, the area of the rear end stepped portion of the large-diameter portion becomes small, and hence difficult to sufficiently secure an engagement allowance of the crimped portion. Accordingly, in this case, there is concern that it leads to a decline in gas-tightness and a decline in the stability of the tightened state of the insulator with respect to the metal shell.

SUMMARY OF THE INVENTION

The present invention has been made in view of the above-described circumstances, and an object thereof is to provide a spark plug for an internal combustion engine having a metal shell and insulator capable of attaining sufficient gas-tightness and stability in a tightened state, and which satisfies the demand for a smaller diameter spark plug.

The above object has been achieved by providing (configuration (1)) a spark plug for an internal combustion engine comprising: a cylindrical insulator having an axial hole penetrating in a direction of an axis; a center electrode partially inserted in the axial hole; a metal shell surrounding an outer periphery of the insulator and which is fixed to the insulator by means of a crimped portion provided at a rear end portion of the metal shell; and a ground electrode joined to the metal shell such that a portion of the ground electrode opposes a leading end portion of the center electrode via a spark discharge gap, wherein the insulator has an annular groove portion which opposes an inner edge of the crimped portion.

According to configuration (1) above, an annular groove portion 23 is provided on at least a portion of the insulator 2 opposing an inner edge of the crimped portion 20. Accordingly, it is possible to sufficiently secure the engagement allowance B of the crimped portion (see FIGS. 1 and 4). As a result, it is also possible to prevent a decline in gas-tightness between the metal shell 3 and the insulator 2 and to prevent a decline in the stability of the tightened state of the metal shell and the insulator. In particular, even in a case where the large-diameter portion 11 of the insulator 2 is reduced in diameter, and a difference in diameter between that large-diameter portion and the rear end-side trunk portion 10 is set to be relatively small, a sufficient engagement allowance B can still be secured by providing the annular groove portion 23. Namely, by adopting this configuration, the metal shell 3 and the insulator 2 are capable of attaining sufficient gas-tightness and stability in a tightened state and are capable of responding to the demand for a smaller diameter. In addition, not all of the rear end-side trunk portion 10 of the insulator 2 is reduced in diameter, and the annular groove portion 23 is only formed in the portion opposing the crimped portion 20. Consequently, an advantage is that a conventional, commonly used plug cap may be connected to the spark plug.

In a preferred embodiment (configuration (2)), the spark plug of configuration (1) is characterized in that the metal shell has, on its outer periphery, a threaded portion for threadedly engaging a mounting hole of an engine head of the internal combustion engine, said threaded portion having an outside diameter less than or equal to M12 (having an outside diameter of 12 mm or less), and the insulator includes a large-diameter portion entirely accommodated in the metal shell and a rear end-side trunk portion provided on a rear end side of the annular groove portion and whose diameter is smaller than that of the large-diameter portion, and a difference in radius between the large-diameter portion and the rear end-side trunk portion is less than 0.6 mm.

A technique for improving gas-tightness has been proposed in which, at the time of assembling the insulator and the metal shell, an arrangement (also referred to as a "talc ring") having talc filled between a pair of ring members is provided between the inner peripheral surface of the metal shell and the outer peripheral surface of the rear end-side trunk portion, and the crimped portion is retained at the rear end-side ring member (e.g., JP-A-2004-363112). However, when realizing a small-diameter spark plug, if the difference in radius between the large-diameter portion and the rear end-side trunk portion is made relatively small, the gap between the inner peripheral surface of the metal shell and the outer peripheral surface of the rear end-side trunk portion is also bound to be made small. It therefore becomes necessary to make the ring member thin-walled, but there is a limit. A so-called "heat crimping type" spark plug has conventionally been proposed in which the crimped portion is retained at the rear end portion of the large-diameter portion without providing the talc ring. In this case, if the diameter is not very small, it is possible to secure an engagement allowance of 0.6 mm or more, and it has been possible to secure a sufficiently tightened state. However, even with such a "heat crimping type," in a case where a further reduction in diameter is required, sufficient engagement allowance cannot always be secured.

In the spark plug of configuration (2), a reduction in diameter is attained as the outside diameter of the threaded portion 15 is less than or equal to M12 (defined in JIS B 8031:2006), and the difference in radius between the large-diameter portion and the rear end-side trunk portion 10 is less than 0.6 mm. In such an arrangement, it becomes very difficult to provide a talc ring, and the "heat calking type" such as described above can be adopted. In such a configuration, since the annular groove portion 23 is provided on a portion of the insulator 2 opposing at least the inner edge of the crimped portion 20, it is possible to secure an adequate engagement allowance B of the crimped portion. Namely, in attaining a reduction of the diameter of the spark plug, even in the case where the talc ring cannot be provided, it is possible to sufficiently secure gas-tightness and attain a stabilized tightened state. As a configuration for rendering the invention even more effective, a spark plug in which the outside diameter of the threaded portion is less than or equal to M10 (defined in JIS B 8031:2006) also may be adopted.

In a preferred embodiment (configuration (3)), the spark plug of configuration (2) is characterized in that the crimped portion is retained at a rear end portion of the large-diameter portion of the insulator, and in the cross section including the axis of the insulator, an engagement allowance defined as a distance between an inner end point of the crimped portion and a radially outer end of the large diameter portion in a direction perpendicular to the direction of the axis, is 0.2 mm or more.

Since, in the cross section including the axis of the insulator, the engagement allowance B of the retaining portion of the crimped portion 20 with respect to the large-diameter portion 11 in a direction perpendicular to the axial direction is set to greater than or equal to 0.2 mm, the above-described operational effect can be exhibited more reliably.

In a preferred embodiment (configuration (4)), the spark plug of any one of the above-described configurations (1) to (3) is characterized in that, in the cross section including the axis of the insulator, a distance between an inner end point of the crimped portion and a minimum-diameter portion of the annular groove portion in a direction perpendicular to the direction of the axis is 0.2 mm or more.

In a case where an interval between the inner edge of the crimped portion and the insulator is relatively small, when an impact is applied from the outside, the inner edge of the crimped portion and the insulator can possibly collide against each other. In this case, coupled with the fact that the inner edge of the crimped portion in general is relatively thin-walled, the insulator can be damaged, possibly leading to the occurrence of a crack in the insulator. In this respect, according to configuration (4), the annular groove portion 23 is provided such that, in the cross section including the axis C1 of the insulator, the distance A between the inner end point of the crimped portion 20 and the minimum-diameter portion of the annular groove portion (a portion of the annular groove portion located on the radially innermost side) in a direction perpendicular to the axial direction becomes greater than or equal to 0.2 mm. Accordingly, a sufficient clearance A can be secured between the inner edge of the crimped portion 20 and the insulator 2, and it becomes possible to prevent a collision between the inner edge of the crimped portion and the insulator, and hence prevent cracking of the insulator.

In a preferred embodiment (configuration (5)), the spark plug of any one of the above-described configurations (1) to (4) is characterized in that the insulator comprises a rear end-side trunk portion provided on a rear end side of the annular groove portion, and a diameter of an opening defined by the inner edge of the crimped portion is smaller than a diameter of the insulator at a boundary between the rear end-side trunk portion and the annular groove portion.

According to configuration (5), the diameter of the opening formed by the inner edge of the crimped portion 20 is made smaller than the diameter of the insulator 2 at the boundary between the rear end-side trunk portion 10 and the annular groove portion 23. Namely, as shown in FIG. 5, the inner edge of the crimped portion 20 is set in a state of being thrust in the annular groove portion (such that the inner edge of the crimped portion projects inwardly of the outside periphery of the insulator at a corner defined by the line 10 and the line 25 as shown in FIG. 3), and it becomes possible to set the engagement allowance B for the crimped portion without imposing any restriction on the outside diameter of the rear end-side trunk portion 10 of the insulator. Hence it becomes possible to secure a greater engagement allowance B for the crimped portion 20, and the above-described operational effect is exhibited more reliably.

In a preferred embodiment (configuration (6)), the spark plug of any one of the above-described configurations (1) to (5) is characterized as further comprising a glazing layer covering the annular groove portion.

Because the annular groove portion 23 is provided in the insulator 2, it is possible to secure the engagement allowance B of the crimped portion 20, while the wall thickness of the insulator 2 at that portion becomes small. Accordingly, there is concern that the strength at that portion more or less declines. In this respect, according to configuration (6), the annular groove portion is covered with a glazing layer. The annular groove portion is reinforced by covering with the glazing layer, and the surface of the insulator having very small cracks, holes, and the like can be smoothened. This makes it possible to improve the strength of the insulator. Here, the formation of the glazing layer on a predetermined portion of the insulator is an important step in the process of manufacturing the spark plug. Therefore, according to configuration (6), even if a complex reinforcing measure is not separately provided, it is possible to effectively prevent a decline in the strength of the insulator due to provision of the annular groove portion. The glazing layer may be provided up to the rear end portion of the large-diameter portion 11 having a shape such as a curved surface shape, a stepped shape, or a tapered shape in the insulator.

In a preferred embodiment (configuration (7)), the spark plug of any one of the above-described configurations (1) to (6) is characterized in that the annular groove portion has a bottom wall portion comprising the minimum-diameter portion and a tapered rear wall portion formed continuously from a rear end side of the bottom wall portion, and in a cross-section including the axis of the insulator an angle formed by an extension line of an outer configuration line of the bottom wall portion and an outer configuration line of the tapered rear wall portion is 40 degrees or less.

In configuration (7), the annular groove portion 23 has a bottom wall portion 24 including the minimum-diameter portion and a tapered rear wall portion 25 formed continuously from a rear end side of the bottom wall portion 24. Here, if an angle formed by the bottom wall portion and the rear wall portion becomes close to a right angle, stress is concentrated on a boundary between the bottom wall portion 25 and the rear wall portion 24, so that there is a possibility that cracking occurs at that boundary or in the vicinity thereof. In contrast, according to this configuration, in the cross-section including the axis C1 of the insulator 2, an angle formed by an extension line of an outer configuration line 24*a* of the bottom wall portion 24 and an outer configuration line 25*a* of the tapered rear wall portion 25 is set to less than or equal to 40 degrees. This makes it possible to prevent the concentration of stress at the boundary between the bottom wall portion and the rear wall portion and prevent a situation in which the insulator cracks due to provision of the annular groove portion. In the case where the glazing layer is provided on the annular groove portion, the angle formed by an extension line of an outer configuration line of the glazing layer surface covering the bottom wall portion and an outer configuration line of the glazing layer surface covering the rear wall portion is set to less than or equal to 40 degrees.

DESCRIPTION OF REFERENCE NUMERALS

Figure 1:
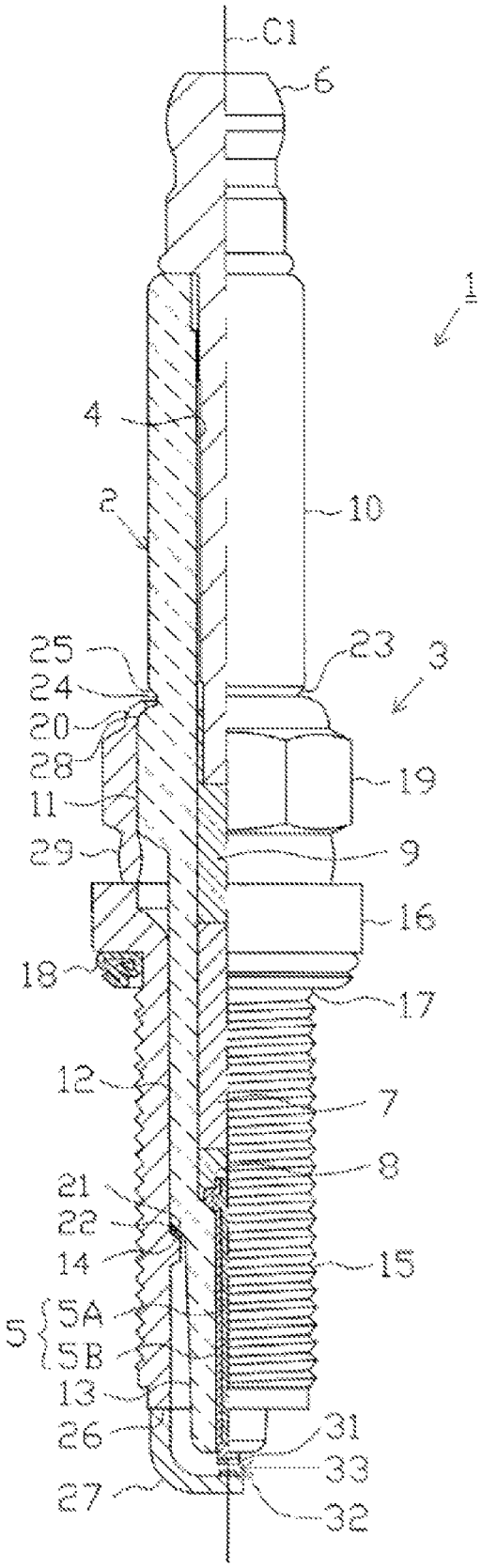
FIG. 1 is a fragmentary front elevational view illustrating the configuration of a spark plug in accordance with an embodiment of the invention.

Reference numerals used to identify various structural features in the drawings include the following.

1: spark plug, 2: insulator, 3: metal shell, 4: axial hole, 5: center electrode, 10: rear end-side trunk portion, 11: large-diameter portion, 15: threaded portion, 20: crimped portion, 23: annular groove portion, 24: bottom wall portion, 24*a*; outer configuration line of the bottom wall portion, 25: rear wall portion, 25*a*: outer configuration line of the rear wall portion, 27: ground electrode, 33: spark discharge gap, C1: axis

DETAILED DESCRIPTION OF THE INVENTION

Hereafter, a description will be given of an embodiment of the invention with reference to the drawings. However, the present invention should not be construed as being limited thereto.

FIG. 1 is a fragmentary front elevational view illustrating a spark plug 1. In FIG. 1, the direction of an axis C1 of the spark plug 1 is a vertical direction in the drawing, the lower side of the drawing is a leading end side of the spark plug 1, and the upper side is a rear end side thereof.

The spark plug 1 is comprised of a cylindrical insulator 2, a cylindrical metal shell 3 for holding it, and the like.

An axial hole 4 is penetratingly formed in the insulator 2 along the axis C1. A center electrode 5 is inserted and fixed in a leading end portion side of the axial hole 4, and a terminal electrode 6 is inserted and fixed in a rear end portion side thereof. A resistor 7 is disposed between the center electrode 5 and the terminal electrode 6 inside the axial hole 4, and opposite end portions of this resistor 7 are electrically connected to the center electrode 5 and the terminal electrode 6 through glass seal layers 8 and 9, respectively.

The center electrode 5 is fixed so as to protrude from the leading end of the insulator 2, and the terminal electrode 6 is fixed so as to protrude from the rear end of the insulator 2. In addition, a noble metal tip 31 is joined to the leading end of the center electrode 5 by welding (which will be described below).

Figure 2:
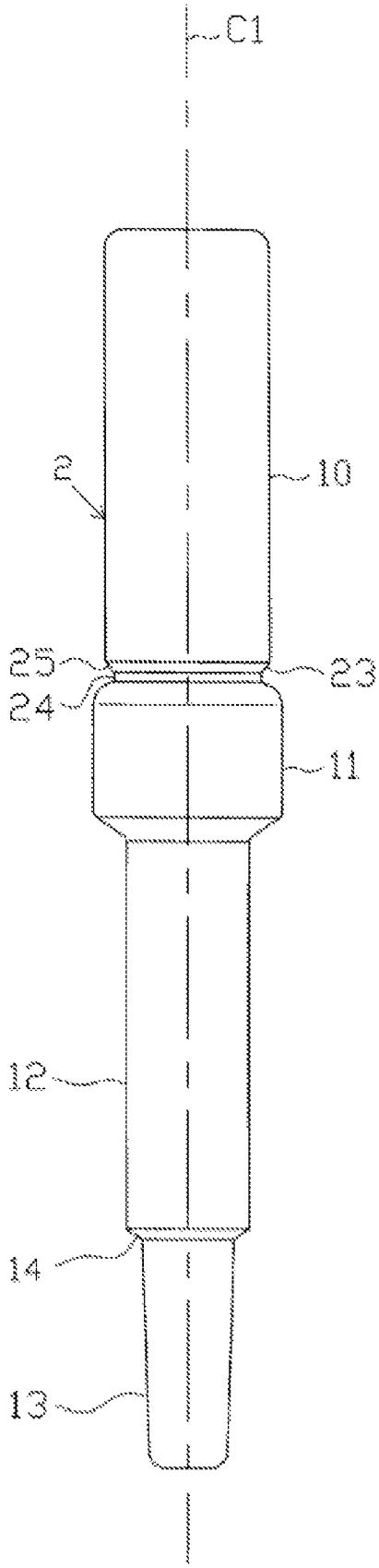
FIG. 2 is a front elevational view illustrating the configuration of an insulator of the spark plug.

Meanwhile, as shown in FIG. 2, the insulator 2 is formed by baking alumina or the like, and includes in its outer configuration portion a rear end-side trunk portion 10 formed on the rear end side; a large-diameter portion 11 formed so as to protrude radially outward at a location closer to the leading end side than that rear end-side trunk portion 10; a middle trunk portion 12 formed closer to the leading end side than that large-diameter portion 11 and having a smaller diameter than the same; and a long leg portion 13 formed closer to the leading end side than that middle trunk portion 12 and having a smaller diameter than the same, the long leg portion 13 being exposed to the interior of the internal combustion engine. The large-diameter portion 11, the middle trunk portion 12, and a major portion of the long leg portion 13 of the insulator 2 are accommodated within the metal shell 3 formed in a cylindrical shape. Further, a stepped portion 14 is formed at a connecting portion between the long leg portion 13 and the middle trunk portion 12, and the insulator 2 is retained by the metal shell 3 at this stepped portion 14. In addition, a difference in radius between the rear end-side trunk portion 10 and the large-diameter portion 11 is set to less than 0.6 mm (0.3 mm in this embodiment). Additionally, a rear end portion of the large-diameter portion 11 is formed as a shoulder portion 28 having a curved surface.

The metal shell 3 is formed of a metal such as low carbon steel into a cylindrical shape, and has on its outer peripheral surface a threaded portion (externally threaded portion) 15 for installing the spark plug 1 in an engine head. Here, the outside diameter of the threaded portion 15 is set to less than or equal to M12 (M12 in this embodiment). In other words, the spark plug 1 of this embodiment is made relatively small in diameter. In addition, a seat portion 16 is formed on the outer peripheral surface of the rear end side of the threaded portion 15, and a ring-like gasket 18 is fitted on a thread neck 17 at the rear end of the threaded portion 15. Further, on the rear end side of the metal shell 3, there are provided a tool engaging portion 19 with a hexagonal cross-sectional shape for engaging a tool, such as a wrench, at the time of installing the metal shell 3 in the engine head, as well as a crimped portion 20 for holding the insulator 2 at the rear end portion.

In addition, a stepped portion 21 for retaining the insulator 2 is provided on the inner peripheral surface of the metal shell 3. The insulator 2 is inserted from the rear end side of the metal shell 3 toward the leading end side thereof. In a state in which the stepped portion 14 of the insulator 2 is retained by the stepped portion 21 of the metal shell 3, an opening at the rear end side of the metal shell 3 is crimped radially inward, i.e., the aforementioned crimped portion 20 is formed, and the insulator 2 is thereby fixed. As a result, the inner peripheral surface of the crimped portion 20 is retained in conformity with the aforementioned shoulder portion 28. An annular plate packing 22 is interposed between respective stepped portions 14 and 21 of the insulator 2 and the metal shell 3. This ensures that the gas-tightness of the interior of a combustion chamber is maintained, and that a fuel-air mixture entering the gap between the long leg portion 13 of the insulator 2 and the inner peripheral surface of the metal shell 3, which is exposed to the interior of the combustion chamber, does not leak to the outside.

In addition, a substantially L-shaped ground electrode 27 is joined to a leading end face 26 of the metal shell 3. Namely, the ground electrode 27 is disposed such that its rear end portion is welded to the leading end face 26 of the metal shell 3, and its leading end side is bent to cause its side surface to oppose the leading end portion (noble metal tip 31) of the center electrode 5. A noble metal tip 32 is provided on that ground electrode 27 so as to oppose the noble metal tip 31. The gap between these noble metal tips 31 and 32 serves as a spark discharge gap 33.

The center electrode 5 is composed of an inner layer 5A formed of copper or a copper alloy and an outer layer 5B formed of a nickel (Ni) alloy. Also, the ground electrode 27 is formed of a Ni alloy or the like.

The center electrode 5 has its leading end side reduced in diameter and is formed into a rod shape (cylindrical shape) as a whole, and its leading end face is formed flat. The aforementioned cylindrical noble metal tip 31 is superposed thereon, and the metal shell 31 and the center electrode 5 are joined by laser welding, electron beam welding, resistance welding, or the like along an outer edge portion of its joint surface. Meanwhile, the noble metal tip 32 opposed thereto is positioned at a predetermined position on the ground electrode 27, and is joined by welding along an outer edge portion of its joint surface. Either one (or both) of the noble metal tip 31 and the noble metal tip 32 opposed thereto may be omitted. In this case, the spark discharge gap 33 is formed between the noble metal tip 32 and a main body portion of the center electrode 5 or between the noble metal tip 31 and a main body portion of the ground electrode 27, which oppose each other, respectively.

In this embodiment, the aforementioned noble metal tips 31 and 32 are formed of a known noble metal material (e.g., a Pt—Ir alloy or the like).

Figure 3:
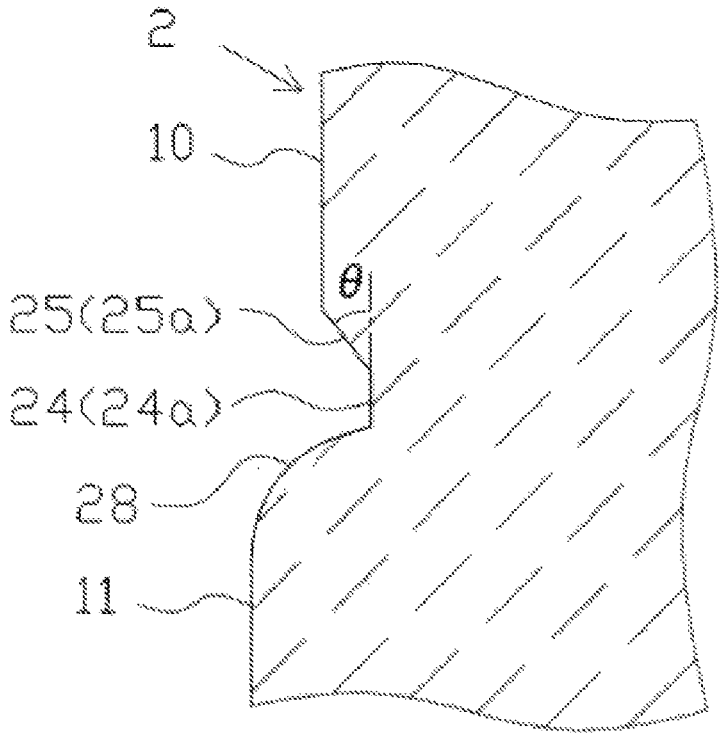
FIG. 3 is an enlarged cross-sectional view illustrating an angle formed by a bottom wall portion and a rear wall portion of an annular groove portion.
Figure 4:
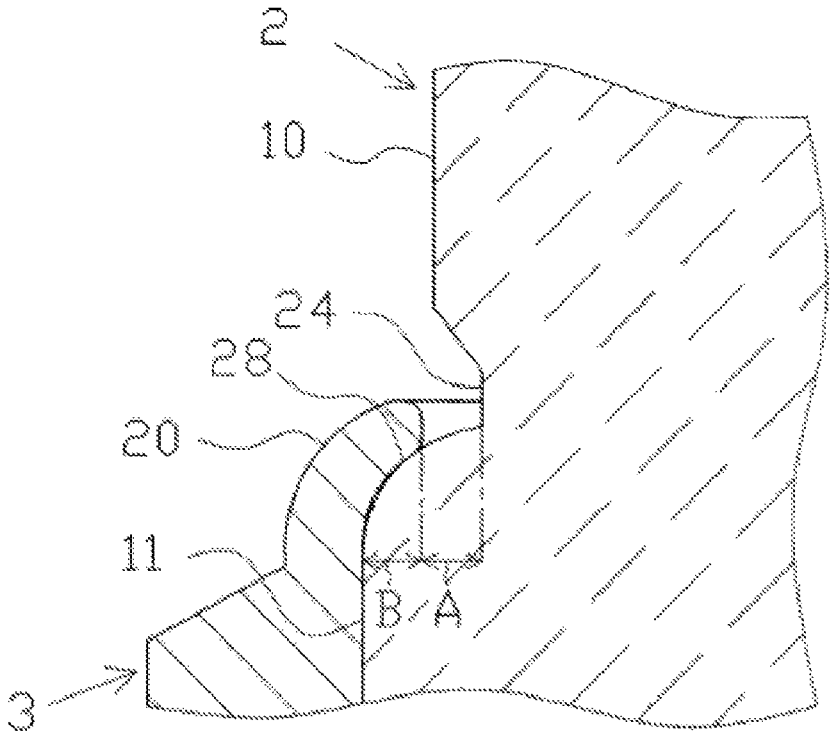
FIG. 4 is an enlarged cross-sectional view illustrating a distance between an inner end point of a crimped portion and the bottom wall portion, and a distance between the inner end point of the crimped portion and a radially outer end of a large-diameter portion.

In addition, as shown in FIGS. 1 and 2, an annular groove portion 23 is formed over the entire periphery of a portion of the insulator 2 which opposes an inner edge of the crimped portion 20 (a boundary portion between the large-diameter portion 11 and the rear end-side trunk portion 10). The annular groove portion 23 includes a bottom wall portion 24, i.e., a minimum-diameter portion located on the radially innermost side, as well as a tapered rear wall portion 25 formed continuously from a rear end side of that bottom wall portion 24. Further, as shown in FIG. 3, in a cross section including the axis C1, an angle θ formed by an extension line of an outer configuration line 24*a* of the bottom wall portion 24 and an outer configuration line 25*a* of the rear wall portion 25 is set to less than or equal to 40 degrees (35 degrees in this embodiment). In addition, as shown in FIG. 4, in the cross section including the axis C1, a distance A between an inner end point of the crimped portion 20 and the aforementioned bottom wall portion 24 in a direction perpendicular to the direction of the axis C1 is set to greater than or equal to 0.2 mm (0.25 mm in this embodiment), and a distance B between the inner end point of the crimped portion 20 and a radially outer end of the large-diameter portion 11 in the direction perpendicular to the direction of the axis C1 is set to greater than or equal to 0.2 mm (0.25 mm in this embodiment). Namely, in this embodiment, A and B are set such that the inner edge of the crimped portion 20 is not thrust in the annular groove portion 23.

Next, a description will be given of a method of manufacturing the spark plug 1 configured as described above. First, the metal shell 3 is processed in advance. Namely, a cylindrical metallic material (e.g., an iron-based material or a stainless steel material such as S17C or S25C) is subjected to cold forging to thereby form a through hole and create a rough form. Then, the rough form is subjected to cutting to arrange an outer shape, thereby obtaining an intermediate body of the metal shell.

Subsequently, the ground electrode 27 formed of a Ni-based alloy (e.g., an Inconel-based alloy or the like) is resistance welded to a leading end face of the intermediate body of the metal shell. So-called sagging occurs in the welding, so that after the sagging is eliminated, the threaded portion 15 is formed at a predetermined portion of the intermediate body of the metal shell by rolling. As a result, the metal shell 3 with the ground electrode 27 welded thereto is obtained. The metal shell 3 with the ground electrode 27 welded thereto is subjected to zinc plating or nickel plating. To improve corrosion resistance, its surface may be further subjected to chromate treatment.

Furthermore, the aforementioned noble metal tip 32 is joined to the leading end portion of the ground electrode 27 by resistance welding, laser welding or the like. To render the welding more reliable, the plating at the welded portion is removed prior to welding, or the portion to be welded is masked during the plating process. In addition, the noble metal tip 32 may be welded after the assembly which will be described below.

Meanwhile, the insulator 2 is fabricated in advance separately from the above-described metal shell 3. For example, green granules for molding are prepared from a raw material powder comprising mainly alumina and including a binder and the like, and a cylindrical compact is obtained by rubber press molding the green granules. The compact thus obtained is subjected to grinding and is thereby shaped. At the time of the grinding, the portion of the insulator 2 which will oppose the inner edge of the aforementioned crimped portion 20 is ground to form a groove portion which later serves as the annular groove portion 23. The shaped piece is then charged into a baking furnace and is baked. After baking, various polishing is carried out to thereby obtain the insulator 2. The groove portion may be formed at the time of polishing, or formation of the groove portion may be completed at the time of grinding prior to baking, and polishing after baking may not be needed.

In addition, the center electrode 5 is fabricated in advance separately from the metal shell 3 and the insulator 2 mentioned above. Namely, an Ni-based alloy is subjected to forging, and the inner layer 5A made of a copper alloy is provided in its central portion so as to improve radiation performance. Further, the aforementioned noble metal tip 31 is joined to its leading end portion by resistance welding, laser welding or the like.

Then, the insulator 2 and the center electrode 5 obtained as described above, as well as the resistor 7 and the ground electrode 27, are sealed and fixed by the glass seal layers 8 and 9. The glass seal layers 8 and 9 are generally prepared by mixing borosilicate glass and a metal powder. After the prepared mixture is charged into the axial hole 4 of the insulator 2 so as to sandwich the resistor 7, and the terminal electrode 6 is set in a state of being pressed from the rear, the prepared mixture is baked and hardened in the baking furnace. At this time, a glazing layer may be simultaneously baked on the surface of the rear end-side trunk portion 10 of the insulator 2, or a glazing layer may be formed thereon beforehand.

Subsequently, the metal shell 3 having the ground electrode 27, as well as the insulator 2 having the center electrode 5 and the terminal electrode 6, which have been respectively prepared as described above, are assembled. At the time of the assembly, crimping is carried out by heat crimping. Namely, in a state in which a thin-walled portion 29 formed between the seat portion 16 and the tool engaging portion 19 of the metal shell 3 is heated to reduce the deformation resistance, the opening on the rear end side of the metal shell 3 is crimped. This simultaneously accomplishes crimping based on plastic deformation of the crimped portion 20 and crimping making use of the difference in thermal expansion between the insulator 2 and the metal shell 3. As the thin-walled portion 29 which was in a thermally expanded state is cooled, the thin-walled portion 29 shrinks in the direction of the axis C1, and the crimped portion 20 retained at the shoulder portion 28 of the large-diameter portion 11 presses the shoulder portion 28 toward the leading end side. As a result, the stepped portion 14 formed on the outer peripheral surface of the insulator 2 and the stepped portion 21 formed on the inner peripheral surface of the metal shell 3 are set in a firmly retained state, which, in turn, firmly combines the insulator 2 and the metal shell 3.

Then, finally, by bending the ground electrode 27, working is carried out for adjusting the aforementioned spark discharge gap 33 between the noble metal tip 31 provided at the leading end of the center electrode 5 and the noble metal tip 32 provided at the ground electrode 27.

As the series of steps are thus carried out, the spark plug 1 having the above-described configuration is manufactured.

Next, to confirm the operational effects produced in accordance with this embodiment, various samples were prepared by changing various conditions, and various evaluations were made. The results of the experiment are described below.

First, spark plugs were fabricated in which the following conditions were variously changed: the angle θ (hereafter referred to as the groove portion angle θ) formed between the extension line of the outer configuration line 24*a* of the bottom wall portion and the outer configuration line 25*a* of the rear wall portion in the cross section including the axis of the insulator; the distance A (hereafter referred to as the clearance length A) between the inner end point of the crimped portion and the bottom wall portion in a direction perpendicular to the axial direction; and the distance B (hereafter referred to as the engaging length B) between the inner end point of the crimped portion and the radially outer end of the large-diameter portion in the direction perpendicular to the axial direction. Then, an impact resistance test, a gas-tightness test, and a crimped portion strength test were carried out. It should be noted that, in each sample, the outside diameter of the threaded portion was set to M12, and the diameter of the large-diameter portion 11 was set to 11.6 mm. In addition, a glazing layer was formed on a portion of the insulator ranging from its rear end portion toward the leading end side up to the large-diameter portion, i.e., including the annular groove portion.

Figure 6:
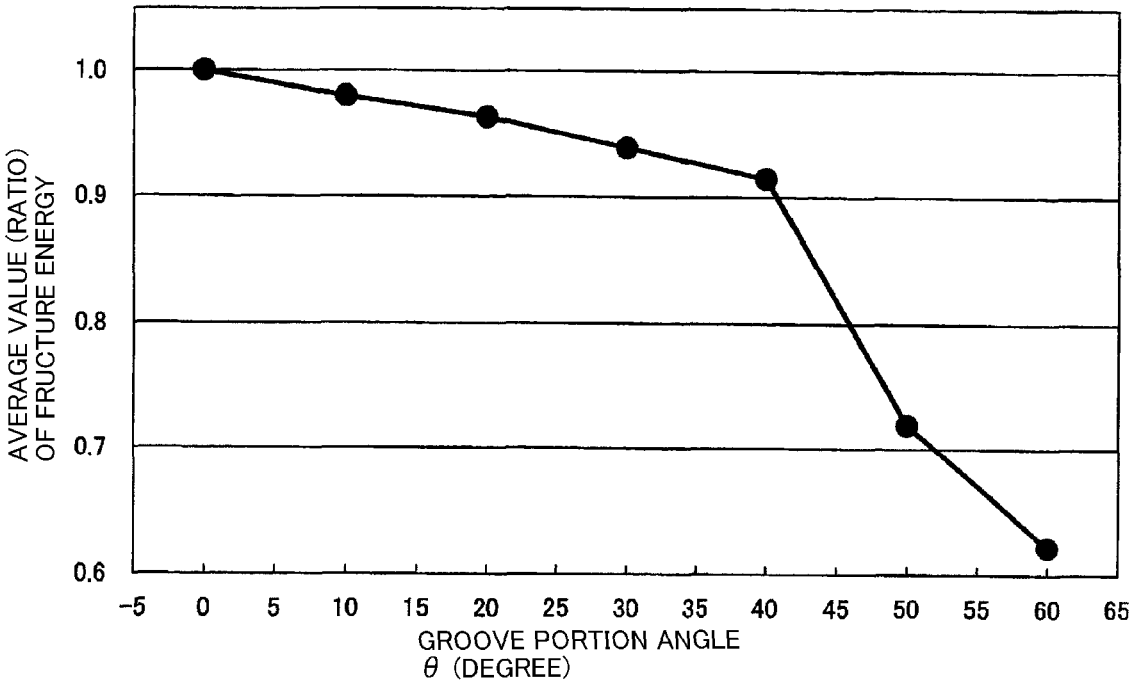
FIG. 6 is a graph illustrating the relationship between a groove portion angle and an average value of fracture energy, which parameters are varied in an impact resistance test.
Figure 7:
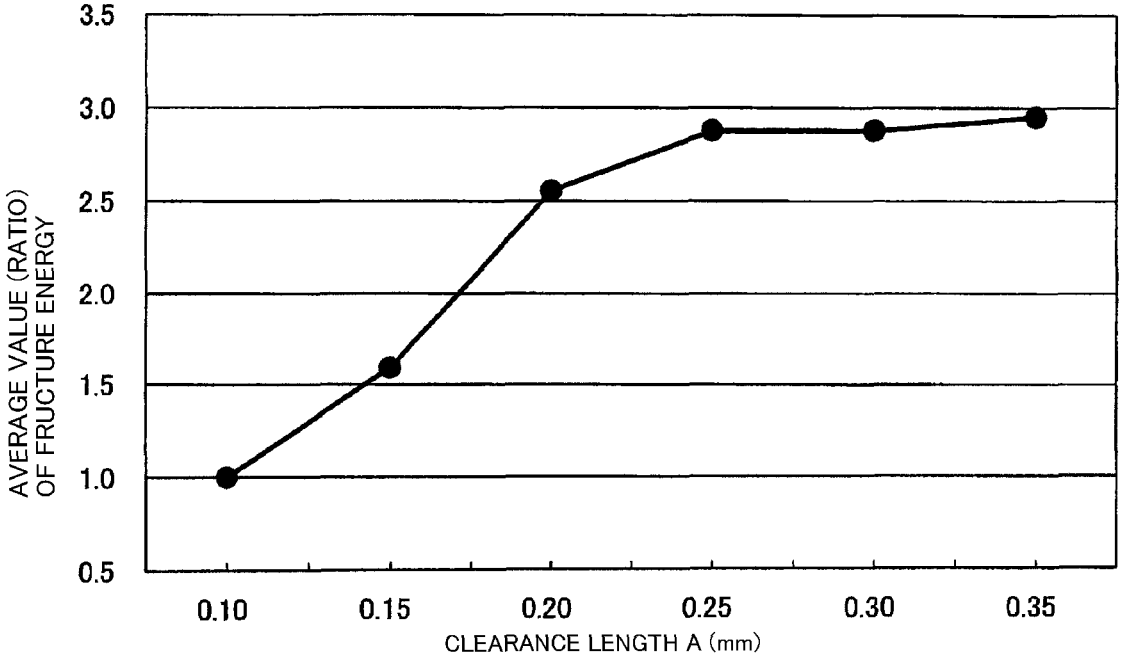
FIG. 7 is a graph illustrating the relationship between a clearance length and an average value of fracture energy, which parameters are varied in the impact resistance test.

As the impact resistance test, a heretofore known Charpy impact test was carried out with respect to samples in which the groove portion angle θ was variously changed and samples in which the clearance length A was variously changed. The outline of the Charpy impact test is as follows: Namely, the spark plug is fixed such that the axial direction of the spark plug is set in the vertical direction, the spark discharge gap is oriented on the lower side, and the threaded portion of the metal shell is threadedly engaged with the threaded hole of a test bench. In addition, a 330 mm long arm to a distal end of which a 1.13 kg hammer made of steel is attached is swingably provided at a pivotal point axially above the spark plug. At this time, the position of the pivotal point is set such that the position of the hammer at a time when it is swung down to the rear end portion of the insulator collides against a portion located approximately 1 mm from the rear end face of the insulator. Then, the tip of the hammer is collided against the insulator while a swing angle between the center axis of the arm and the axis of the spark plug is made gradually larger by predetermined angles. This operation was repeatedly carried out, and the swing angle at the time when fracture occurred in the insulator and the fracture energy based on that swing angle were determined under various conditions. This test was conducted in groups of five specimens of the same shape, and average values of the fracture energy were calculated. FIG. 6 shows the relationship between, on the one hand, the groove portion angle θ in cases where the groove portion angle θ was variously changed to 0 degree (no groove), 10 degrees, 20 degrees, 30 degrees, 40 degrees, 50 degrees and 60 degrees and, on the other hand, a ratio of the average value of fracture energy at each groove portion angle θ to the fracture energy at the groove portion angle θ of 0 degree (no groove). In FIG. 6, the groove portion angle θ is taken as the abscissa, and the ratio of the average value of fracture energy is taken as the ordinate. It should be noted that the clearance length A at this time was set to 0.2 mm. In addition, FIG. 7 shows the relationship between, on the one hand, the clearance length A in cases where the clearance length A was variously changed to 0.10 mm, 0.15 mm, 0.20 mm, 0.25 mm, 0.30 mm and 0.35 mm and, on the other hand, a ratio of the average value of fracture energy at each clearance length A to the fracture energy at the clearance length A of 0.10 mm. In FIG. 7, the clearance length A is taken as the abscissa, and the ratio of the average value of fracture energy is taken as the ordinate. The groove portion angle θ at this time is set to 40 degrees. In addition, the results of the evaluation test shown in FIG. 6 verify the gas-tightness and a decline in strength in configuration 7 of the invention, yet still allow for realization of the gas-tightness and stabilization of the tightened state which are the effects of configuration 1 of the invention. Also, it is preferable to set the groove portion angle θ to less than or equal to 40 degrees in the case where a tapered rear wall portion is provided, and the results of the evaluation test shown in FIG. 6 are such as to allow the rear wall portion to be formed in a tapered shape. However, the results of FIG. 6 show a decline in strength of the insulator in the case where the rear wall portion is formed in a tapered shape, and a lower limit of the groove portion angle θ is not particularly limited. However, no problem is presented even if the groove portion angle θ is as small as 5 degrees.

As shown in FIG. 6, as the groove portion angle θ increases, the average value of fracture energy disadvantageously decreases, i.e., fracture occurs in the insulator under a smaller load. In particular, it became clear that if the groove portion angle θ exceeds 40 degrees, the strength of the insulator appreciably declines. Accordingly, to effectively prevent a decline in the strength of the insulator due to provision of the annular groove portion, it is preferable to set the groove portion angle θ to less than or equal to 40 degrees.

In addition, as shown in FIG. 7, as the clearance length A decreases, the average value of fracture energy disadvantageously decreases, i.e., fracture occurs in the insulator under a smaller load. In particular, it became clear that if the clearance length A is less than 0.2 mm, the strength of the insulator appreciably declines. Accordingly, it is preferable to set the depth and the like of the annular groove to allow a clearance length A of at least 0.2 mm. It suffices if the clearance length A is set so that the gas-tightness does not decline, and its effect is produced if the clearance length A is more than or equal to 0.2 mm. This verification test confirms that good insulator strength is secured for a clearance length A of at least 0.35 mm.

Further, the gas-tightness test and the crimped portion strength test were respectively carried out on samples in which the engaging length B was variously changed. The clearance length A was set at 0.2 mm, and in the case where the engaging length B exceeded 0.1 mm, the engaging length B was changed by providing the annular groove portion at a portion opposing the crimped portion to change the depth of that annular groove portion. The changed length of the engaging length B was 0.10 mm, 0.15 mm, 0.20 mm, 0.25 mm, 0.30 mm and 0.35 mm, respectively.

Figure 8:
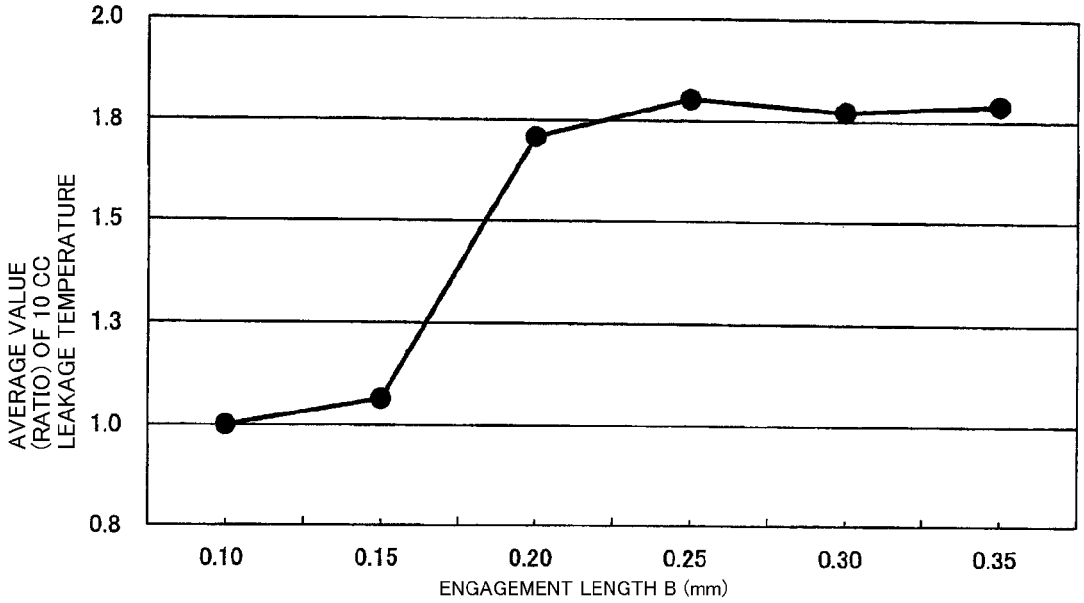
FIG. 8 is a graph illustrating the relationship between an engagement length and an average value of a 10 cc leakage temperature, which parameters are varied in a gas-tightness test.

The outline of the gas-tightness test is as follows: Namely, in the same way as the above-described impact resistance test, the spark plug is fixed such that the axial direction of the spark plug is set in the vertical direction, the spark discharge gap is oriented on the lower side, and the threaded portion of the metal shell is threadedly engaged with the threaded hole of a test bench. Further, in a state in which air pressure of 1.5 Mpa is applied from a lower direction, the spark plug is heated to increase the temperature of the bearing surface (lower end surface of the seat portion 16). As a result, the temperature of the threaded portion when 10 cc air leaked in 1 minute ("10 cc leakage temperature") was measured. This test was also conducted in groups of five specimens of the same shape, and average values of the 10 cc leakage temperature were calculated. FIG. 8 shows the relationship between the engaging length B and a ratio of the average value of the 10 cc leakage temperature at each engaging length B to the average value of the 10 cc leakage temperature at the engaging length B of 0.10 mm. In FIG. 8, the engaging length B is taken as the abscissa, and the ratio of the average value of the 10 cc leakage temperature is taken as the ordinate.

Figure 9:
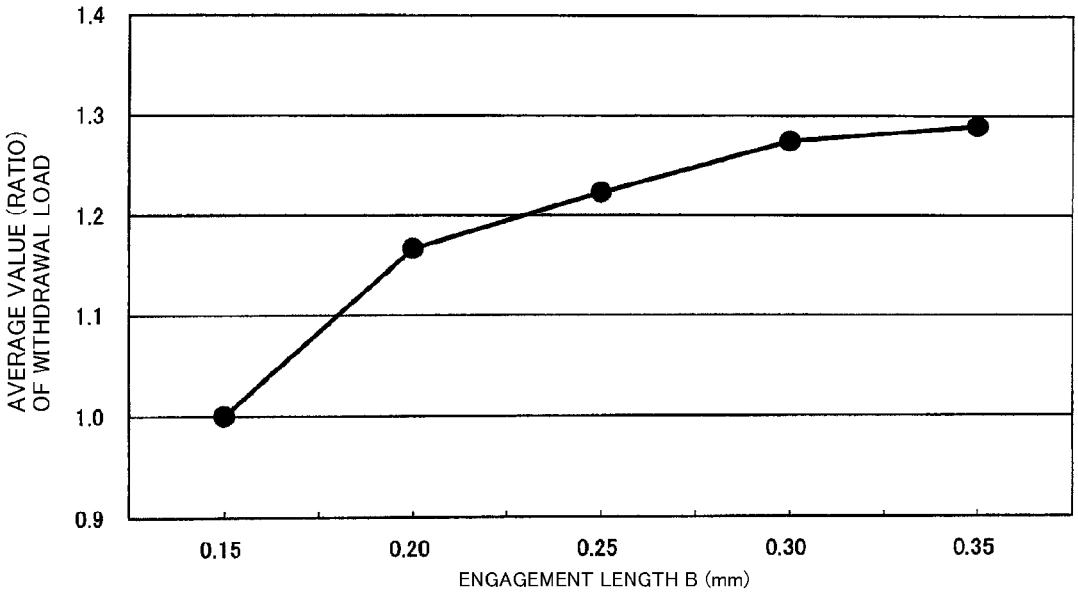
FIG. 9 is a graph illustrating the relationship between the engagement length and an average value of withdrawal load, which parameters are varied in a crimped portion strength test.

In addition, the crimped portion strength test was conducted as follows. Namely, the spark plug is fixed such that the axial direction of the spark plug, in which the ground electrode is removed or the ground electrode is originally not provided, is set in the vertical direction, a portion corresponding to the spark discharge portion is oriented on the lower side, and the threaded portion of the metal shell is threadedly engaged with the threaded hole of a test bench. A load is applied to the insulator from a lower direction, the load is continuously increased, and the withdrawal load when the insulator is withdrawn from the metal shell is measured. This test was also conducted in groups of five specimens of the same shape, and average values of the withdrawal load were calculated. It should be noted that the engaging length B in this test was 0.15 mm, 0.20 mm, 0.25 mm, 0.30 mm, and 0.35 mm respectively. FIG. 9 shows the relationship between the engaging length B and a ratio of the average value of the withdrawal load at each engaging length B to the average value of the withdrawal load at the engaging length B of 0.15 mm. In FIG. 9, the engaging length B is taken as the abscissa in the same way as in the above-described test, and the ratio of the average value of the withdrawal load is taken as the ordinate.

As shown in FIG. 8, as the engaging length B decreases, the average value of the 10 cc leakage temperature declines, i.e., the gas-tightness declines. In particular, it became clear that if the engaging length B is less than 0.2 mm, the gas-tightness appreciably declines. Accordingly, the depth of the annular groove is preferably set to allow an engaging length B of at least 0.2 mm or more.

In addition, as shown in FIG. 9, as the engaging length B decreases, the average value of the withdrawal load decreases, i.e., the insulator is withdrawn from the metal shell under a smaller load. Hence, if an overall determination is made on the results of the above-described gas-tightness test and the crimped portion strength test, it can be said that it is preferable to secure an engaging length B of 0.2 mm or more.

Furthermore, it was found that, from the results of the above-described tests concerning the samples in which the clearance length A and the engaging length B were changed, it is preferable to set the depth of the annular groove portion such that the distance along a direction perpendicular to the axial direction from the bottom wall portion of the annular groove portion to the radially outer end of the large-diameter portion, i.e., the sum of the clearance length A and the engaging length B, becomes greater than or equal to 0.4 mm. In other words, by providing such an annular groove portion, it is possible to attain miniaturization such that the difference in radius between the large-diameter portion and the rear end-side trunk portion becomes less than 0.4 mm while ensuring sufficient gas-tightness and stability in a tightened state.

It should be noted that the invention is not limited to details of the above-described embodiment, and may be implemented as described below, for example. It goes without saying that it is also possible to adopt other applications and modifications which are not illustrated below.

(a) Although no particular reference is given in the above-described embodiment, a glazing layer may be provided so as to cover the annular groove portion 23 after forming the annular groove portion 23. By providing the glazing layer, it is possible to effectively prevent a decline in the strength of the insulator 2 due to the annular groove portion 23. Although the thickness of the glazing layer is not particularly limited, the thickness of the glazing layer is preferably not less than 5 μm and not more than 30 μm.

(b) Although in the above-described embodiment the inner peripheral surface of the crimped portion 20 is directly retained at the shoulder portion 28, a talc ring in which talc is filled between a pair of ring members may be provided between the crimped portion 20 and the shoulder portion 28 (in the gap between the outer peripheral surface of the insulator 2 and the inner peripheral surface of the metal shell 3). Furthermore, an annular metallic plate packing may be provided.

Figure 5:
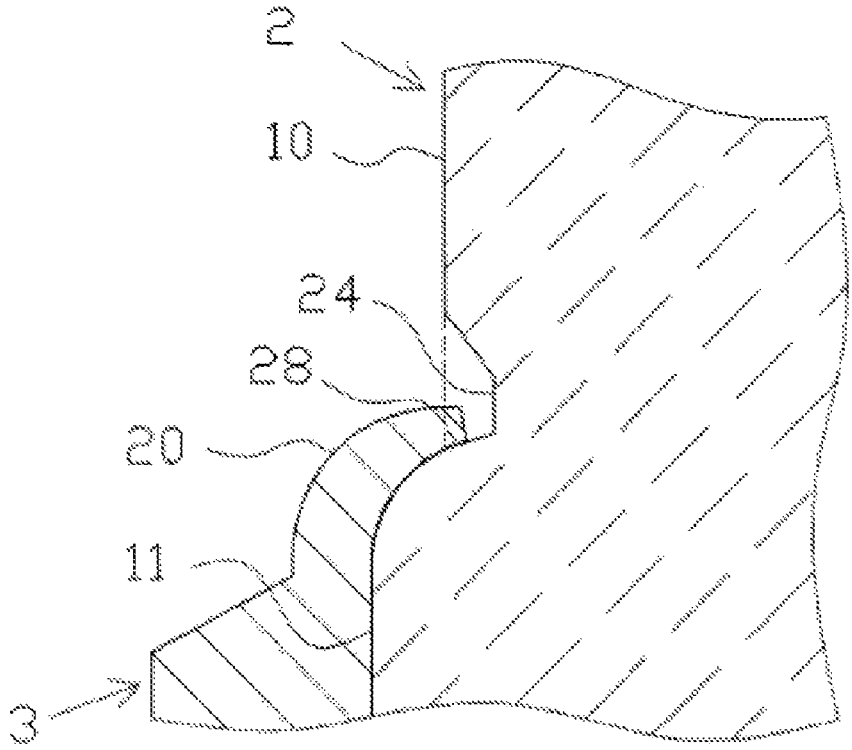
FIG. 5 is an enlarged cross-sectional view illustrating a positional relationship of an inner edge of the crimped portion with respect to the annular groove portion in accordance with another embodiment.

(c) Although in the above-described embodiment the inner edge of the crimped portion 20 is set so as not to be thrust in the annular groove portion 23, the inner edge of the crimped portion 20 may be set in a state of being thrust in the annular groove portion 23, as shown in FIG. 5. In this case, it becomes possible to set the engagement allowance for the crimped portion 20 without imposing any restriction on the outside diameter of the rear end-side trunk portion 10, making it possible to secure a greater engagement allowance for the crimped portion 20.

Figure 10:
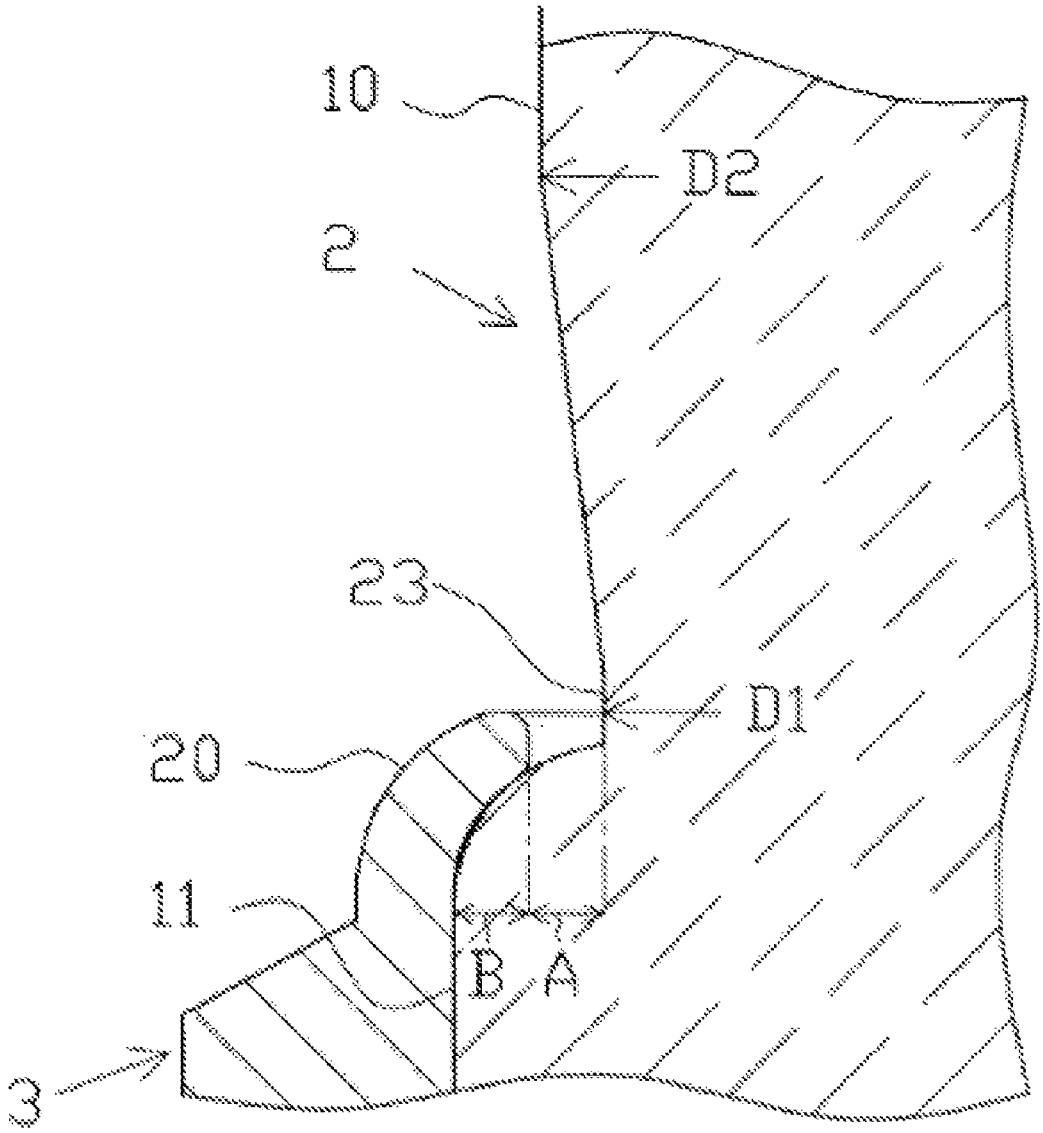
FIG. 10 is a partial enlarged cross-sectional view illustrating the annular groove portion and the like in accordance with yet another embodiment.

(d) The shape of the annular groove portion 23 in the above-described embodiment is only illustrative, and the shape of the annular groove portion 23 is not limited to such a shape. For example, as shown in FIG. 10, the annular groove portion 23 may be provided by forming the annular groove portion 23 so as to form a relatively gentle tapered shape from the leading end of the rear end-side trunk portion 10 toward the large-diameter portion 11 side. Namely, the annular groove portion 23 has a shape capable of sufficiently securing an engagement allowance for the crimped portion 20, and it suffices if the outside diameter D1 of a portion of the insulator 2 opposing the inner edge of the crimped portion 20 is set to be smaller than the outside diameter D2 of the leading end of the rear end-side trunk portion 10.

(e) Although in the above-described embodiment the case in which the ground electrode 27 is joined to the leading end of the metal shell 3 is exemplified, the invention is also applicable to a case in which the ground electrode is formed in such a manner as to shave off a portion of the metal shell (or a portion of a tip fitting welded in advance to the metal shell) (e.g., refer to JP-A-2006-236906).

(f) Although the center electrode 5 of the above-described embodiment has a reduced diameter leading end side, the leading end side of the center electrode 5 may not necessarily be reduced in diameter, and no problem is presented even if the center electrode 5 as a whole is formed in a rod shape (cylindrical shape). In addition, although the center electrode 5 has a double layered structure including the inner layer 5A and the outer layer 5B, the center electrode 5 may consist of only a single layer.

(g) The spark plug is not particularly limited to the type described in the above-described embodiment, and the invention can also be implemented with respect to a spark plug having two to four ground electrodes.

(h) Although the tool engaging portion 19 is provided with a hexagonal cross-sectional shape, the shape of the tool engaging portion 19 is not limited thereto. For example, the tool engaging portion 19 may have a bi-hex (modified 12-point) shape [ISO022977:2005(E)] or the like.

It should further be apparent to those skilled in the art that various changes in form and detail of the invention as shown and described above may be made. It is intended that such changes be included within the spirit and scope of the claims appended hereto.

This application is based on Japanese Patent Application JP 2007-091985, filed Mar. 30, 2007, and Japanese Patent Application JP 2008-006391, filed Jan. 16, 2008, the entire contents of which are hereby incorporated by reference, the same as if set forth at length.

What is claimed is:

1. A spark plug for an internal combustion engine comprising:

a cylindrical insulator having an axial hole penetrating in a direction of an axis;

a center electrode partially inserted in the axial hole;

a metal shell surrounding an outer periphery of the insulator and which is fixed to the insulator by means of a crimped portion provided at a rear end portion of the metal shell; and a ground electrode joined to the metal shell such that a portion of the ground electrode opposes a leading end portion of the center electrode via a spark discharge gap, wherein the insulator has an annular groove portion which opposes an inner edge of the crimped portion, and wherein a line extending from the annular groove portion in a direction which is perpendicular to the axis intersects a rear distal end of the crimped portion.

2. The spark plug for an internal combustion engine according to claim 1, wherein the metal shell has, on its outer periphery, a threaded portion for threadedly engaging a mounting hole of an engine head of the internal combustion engine, said threaded portion having an outside diameter of 12 mm or less, and the insulator comprises a large-diameter portion entirely accommodated in the metal shell and a rear end-side trunk portion provided on a rear end side of the annular groove portion and whose diameter is smaller than that of the large-diameter portion, and a difference in radius between the large-diameter portion and the rear end-side trunk portion is less than 0.6 mm.

3. The spark plug for an internal combustion engine according to claim 2, wherein the crimped portion is retained at a rear end portion of the large-diameter portion of the insulator, and in a cross section including the axis of the insulator, an engagement allowance defined as a distance between an inner end point of the crimped portion and a radially outer end of the large-diameter portion in a direction perpendicular to the direction of the axis, is 0.2 mm or more.

4. The spark plug for an internal combustion engine according to claim 1, wherein in the cross section including the axis of the insulator, a distance between an inner end point of the crimped portion and a minimum-diameter portion of the annular groove portion in a direction perpendicular to the direction of the axis is 0.2 mm or more.

5. The spark plug for an internal combustion engine according to claim 1, wherein the insulator comprises a rear end-side trunk portion provided on a rear end side of the annular groove portion, and a diameter of an opening defined by the inner edge of the crimped portion is smaller than a diameter of the insulator at a boundary between the rear end-side trunk portion and the annular groove portion.

6. The spark plug for an internal combustion engine according to claim 1, further comprising a glazing layer covering the annular groove portion.

7. The spark plug for an internal combustion engine according to claim 1, wherein the annular groove portion has a bottom wall portion comprising the minimum-diameter portion and a tapered rear wall portion formed continuously from a rear end side of the bottom wall portion, and in a cross-section including the axis of the insulator an angle formed by an extension line of an outer configuration line of the bottom wall portion and an outer configuration line of the tapered rear wall portion is 40 degrees or less.

8. The spark plug for an internal combustion engine according to claim 1, wherein a rear end-side trunk portion is provided on a rear end side of the annular groove portion, wherein a minimum-diameter portion of the annular groove portion has a smaller diameter than a portion of the rear end-side trunk portion which contacts the rear end side of the annular groove portion, and wherein the rear end-side trunk portion is provided rearward of the crimped portion.

* * * * *